US010714827B2

(12) United States Patent
Dabrowski et al.

(10) Patent No.: US 10,714,827 B2
(45) Date of Patent: Jul. 14, 2020

(54) SPHERICAL DIELECTRIC LENS SIDE-LOBE SUPPRESSION IMPLEMENTED THROUGH REDUCING SPHERICAL ABERRATION

(71) Applicant: The Boeing Company, Chicago, IL (US)

(72) Inventors: Ted Ronald Dabrowski, Huntsville, AL (US); Larry Leon Savage, Huntsville, AL (US)

(73) Assignee: The Boeing Company, Chicago, IL (US)

( * ) Notice: Subject to any disclaimer, the term of this patent is extended or adjusted under 35 U.S.C. 154(b) by 466 days.

(21) Appl. No.: 15/422,469

(22) Filed: Feb. 2, 2017

(65) Prior Publication Data

US 2018/0219285 A1 Aug. 2, 2018

(51) Int. Cl.

| | |
|---|---|
| ***H01Q 15/08*** | (2006.01) |
| ***H01Q 3/26*** | (2006.01) |
| ***H01Q 17/00*** | (2006.01) |
| ***H01Q 19/06*** | (2006.01) |
| ***H01Q 19/08*** | (2006.01) |

(52) U.S. Cl.

CPC ..... *H01Q 3/2611* (2013.01); *H01Q 15/08* (2013.01); *H01Q 17/001* (2013.01); *H01Q 17/002* (2013.01); *H01Q 17/008* (2013.01); *H01Q 19/062* (2013.01); *H01Q 19/08* (2013.01)

(58) Field of Classification Search

CPC .... H01Q 3/2611; H01Q 19/08; H01Q 19/062; H01Q 19/06; H01Q 19/021; H01Q 17/008; H01Q 17/001; H01Q 17/002; H01Q 15/08

See application file for complete search history.

(56) References Cited

U.S. PATENT DOCUMENTS

| | | | | |
|---|---|---|---|---|
| 3,413,641 | A | 11/1968 | Turrin | |
| 2011/0262145 | A1* | 10/2011 | Ruggiero | G02B 17/0856 398/115 |
| 2012/0287005 | A1* | 11/2012 | Pintos | H01Q 19/06 343/754 |

FOREIGN PATENT DOCUMENTS

| | | | |
|---|---|---|---|
| DE | 19755607 | A1 | 8/1998 |
| EP | 0786825 | A1 | 7/1997 |

(Continued)

OTHER PUBLICATIONS

Balanis, "Advanced Engineering Electromagnetics," 2nd Edition, John & Wiley Sons, Inc., New Jersey, 2012, 1040 pages. (Summary only provided).

(Continued)

*Primary Examiner* — Hoang V Nguyen
*Assistant Examiner* — Awat M Salih
(74) *Attorney, Agent, or Firm* — Yee & Associates, P.C.

(57) ABSTRACT

A method to mitigate an antenna multipath, Rayleigh fading effect. The method includes coupling an antenna on top of a structure, wherein the structure is covered by a radio frequency (RF) radiation absorbing layer, wherein the structure has a shape such that any reflecting surface of the structure is perpendicular to an incoming RF signal. The method also includes directing the incoming RF signal towards the structure, wherein undesired direct or reflected RF signals are either absorbed by the RF radiation absorbing layer or deflected back to a source of the RF signal, thereby avoiding interference of the undesired RF signal with a desired RF signal aimed at the antenna.

20 Claims, 11 Drawing Sheets

(56) References Cited

FOREIGN PATENT DOCUMENTS

| | | | |
|---|---|---|---|
| WO | WO0148549 | A1 | 7/2001 |
| WO | WO2006028272 | A1 | 3/2006 |

OTHER PUBLICATIONS

Young et al., "University Physics with Modern Physics," Addison-Wesley; 12th edition, San Francisco, CA, Mar. 19, 2007, 1598 pages.
Balanis, "Antenna Theory," Second edition, John & Wiley Sons, Inc., New Jersey, 1997, 45 pages.
Extended European Search Report, dated Jul. 6, 2018, regarding Application No. 18154852.0, 11 pages.

* cited by examiner

SPHERICAL DIELECTRIC LENS SIDE-LOBE SUPPRESSION IMPLEMENTED THROUGH REDUCING SPHERICAL ABERRATION

BACKGROUND INFORMATION

1. Field

The present disclosure relates to design of radio frequency (RF) antennas, and more particularly, relates to spherical dielectric lens side-lobe suppression implemented through reducing spherical aberration caused by a spherical lens in the radio frequency (RF) antenna.

2. Background

Radio frequency (RF), hereinafter "RF", antennas have many uses, such as, but not limited, to Radio Detection And Ranging (RADAR), communications, and other applications. There are many different types of RF antennas. One type of antenna includes an RF generator which directs RF energy towards a spherical lens, which in turn focuses the RF energy in a specific manner before exiting the RF antenna.

Far-field antenna pattern side-lobes are inherent undesirable features in virtually all directional RF antennas, including RF antennas with spherical lenses. Side-lobes are portions of the RF energy that are directed away from a desirable direction. These side-lobes result from the generation of the directional radiation pattern of the RF antenna and are increasingly problematic with increasing antenna gain. The radiated energy in these side-lobes is wasted energy. Historically, reduction of antenna side-lobe energy has been difficult and expensive to accomplish.

SUMMARY

The illustrative embodiments provide for a method to mitigate an antenna multipath, Rayleigh fading effect. The method includes coupling an antenna on top of a structure, wherein the structure is covered by a radio frequency (RF) radiation absorbing layer, wherein the structure has a shape such that any reflecting surface of the structure is perpendicular to an incoming RF signal. The method also includes directing the incoming RF signal towards the structure, wherein undesired direct or reflected RF signals are either absorbed by the RF radiation absorbing layer or deflected back to a source of the RF signal, thereby avoiding interference of the undesired RF signal with a desired RF signal aimed at the antenna.

The illustrative embodiments also provide for a radio frequency (RF) antenna configured to reduce RF side-lobes caused by spherical aberration. The RF antenna includes an RF source configured to transmit RF energy in an optical path defined between the RF source and an exit point from the RF antenna. The RF antenna also includes a plug in the optical path after the RF source, the plug comprising an optically active material with respect to RF energy, the plug having three sections of different shapes. The RF antenna also includes a spherical lens in the optical path after the plug.

The illustrative embodiments also provide for a radio frequency (RF) antenna configured to reduce RF side-lobes caused by spherical aberration. The RF antenna includes an RF source configured to transmit RF energy in an optical path defined between the RF source and an exit point from the RF antenna. The RF antenna also includes a plug in the optical path after the RF source, the plug including an optically active material with respect to RF energy, the plug having three sections of different materials, with different permittivities. The RF antenna also includes a spherical lens in the optical path after the plug.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account that energy radiated in side-lobes of an RF antenna is usually considered wasted energy and is usually considered undesirable. The illustrative embodiments recognize and take into account a method to reduce side-lobes of a spherical dielectric lens antenna. The illustrative embodiments recognize and take into account that the refractive properties of a geometrically shaped plug or a multi-material plug, or both, can be used to reduce spherical aberration caused by the spherical lens, and thereby reduce side-lobes. The illustrative embodiments reduce the amount of energy near the edges of a spherical dielectric lens by refracting energy towards the center of the spherical lens. This effect causes less energy to undergo spherical aberration that may cause side-lobes of RF energy.

The illustrative embodiments recognize and take into account that current solutions for reducing side-lobes can be undesirable. For example, one current solution is to increase the cross sectional area of a portion of the waveguide to modify surface current distributions. However, the drawback of using this technique is that more physical space is required to increase the waveguide aperture cross sectional area. Design requirements can rule out this option very quickly in a waveguide array. In another example, complex geometric patterns can be created on the exit port of the waveguide. However, implementation of such geometric modifications will increase the complexity of the overall design and manufacturing process, thereby increasing cost and decreasing reliability of the RF antenna. In still another example, a complex multi-material lens can be used to bring the focal points of the emitter closer to the lens. However, this approach reduces antenna aperture efficiency. The illustrative embodiments solve these and other issues with respect to reducing RF side-lobes in most RF antennas, but especially in an RF antenna that uses a spherical lens.

Figure 1:
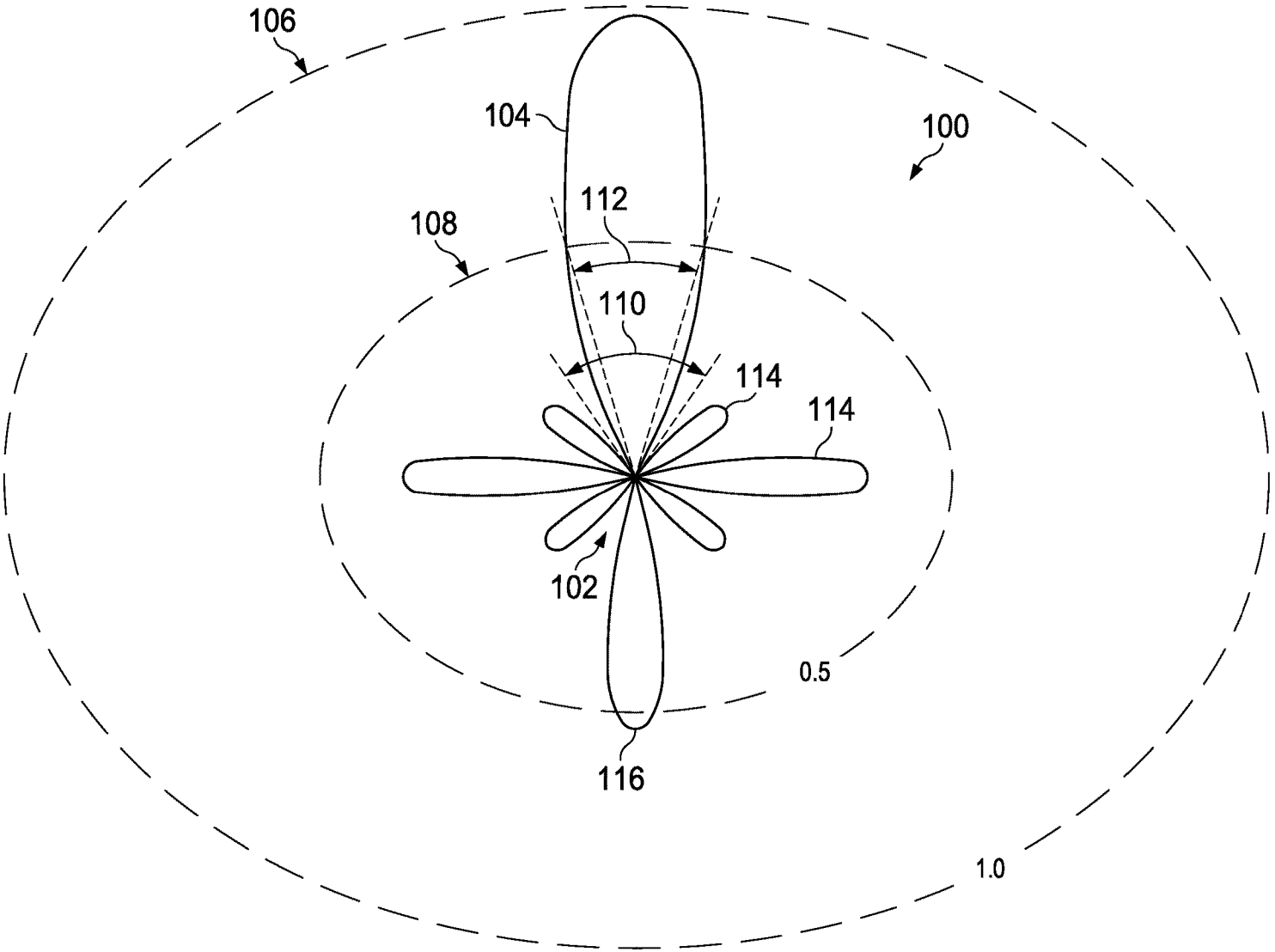
FIG. 1 is an illustration of operating pattern parameters for an RF antenna depicted in accordance with an illustrative embodiment.

FIG. 1 shows an illustration of operating pattern parameters for an RF antenna depicted in accordance with an illustrative embodiment. Thus, FIG. 1 shows radio frequency (RF) energy pattern 100 being emitted from RF source 102. RF energy is, more precisely, many photons (light) having wavelengths roughly in the range 300 GHz (Gigahertz) to 3 kHz (kilohertz). A photon has the properties of both waves and packets, and may be considered a packet of waves of varying electric and magnetic fields.

A RF source can be made to emit an electromagnetic wave by oscillating a charge or charges in simple harmonic motion, such that it has an acceleration at almost every instant. This motion produces a time varying electromagnetic field, which can be represented as a wave using Maxwell's equations. The electromagnetic energy flow can be described by using the electric and magnetic fields on a power per unit-area basis. This concept is called the Poynting vector, which describes both the magnitude and direction of the energy flow rate. A Poynting vector generated for every angle surrounding a RF source, integrated over its respective area, can be used to generate a pattern, such as that shown in FIG. 1.

An important characteristic of a directive antenna is the ability to focus radiated RF energy in a particular direction without radiating spurious energy in undesired directions. The primary direction of focus is referred to as the main lobe, such as main lobe 104. The point where most of the RF energy is expended is at ring 106, which represents the range of the RF antenna. Half power point 108 represents the points where the RF energy is about half that at RF source 102. First null beam width (FNBW) 110 is the location in space where the main lobe ends and there are no side-lobes. Half-power beam width 112 is the width of main lobe 104 where power is half of that at RF source 102.

Energy radiated in undesired directions are referred to as side-lobe energy or back-lobe energy. Side-lobe energy is radiated in side-lobes, such as side-lobes 114. Side-lobe energy will degrade antenna performance and may result in interference. Thus, side-lobe energy often is considered undesirable. Back-lobe energy, such as in back-lobe 116, is also often undesirable, as back-lobe energy is wasted.

Figure 2:
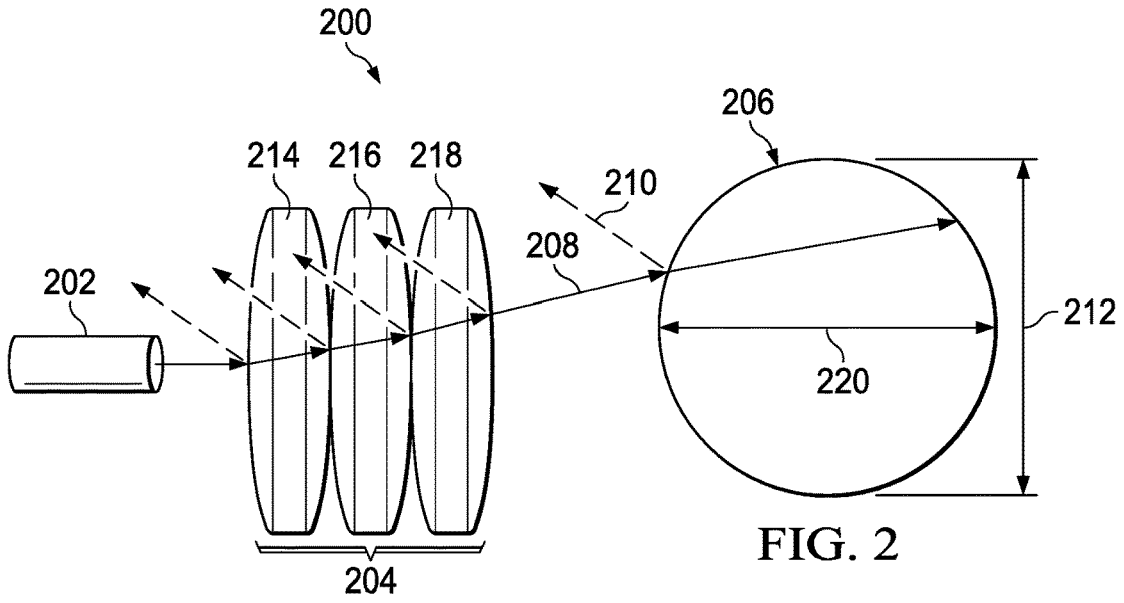
FIG. 2 is an illustration of components of an RF antenna configured to narrow side-lobes depicted in accordance with an illustrative embodiment.

FIG. 2 is an illustration of components of an RF antenna configured to narrow side-lobes depicted in accordance with an illustrative embodiment. Antenna 200 includes, among possible other components, emitter 202, plug 204, and spherical lens 206. Solid arrows 208 show a light path of RF energy from emitter 202, through plug 204, and through spherical lens 206, resulting from refraction at the boundaries of different materials (including the boundary between a solid object and the air (or even a vacuum)). Broken arrows 210 show another light path of the RF energy from emitter 202 resulting from reflection at the same boundaries.

One goal of the illustrative embodiments is to minimize the spread of RF energy across width 212 of spherical lens 206. Thus, after the RF energy has passed through plug 204, the RF energy is more narrowly focused near axis 220 of spherical lens 206, relative to the spread of the RF energy had plug 204 not been present. Because the RF energy is more narrowly focused, spherical aberration of the RF energy passing through spherical lens 206 is greatly reduced. Spherical aberration is an optical effect observed in an optical device (lens, mirror, etc.) that occurs due to the increased refraction of light rays when they strike a lens or a reflection of light rays when they strike a mirror near its edge, in comparison with those that strike nearer the center. As explained above, spherical aberration in an RF antenna leads to side-lobes, which are considered undesirable. Thus, plug 204 of the illustrative embodiments reduces undesirable side-lobes by reducing spherical aberration of the RF energy.

Plug 204 may take several different forms. Only a first form is shown in FIG. 2. In this illustrative embodiment, plug 204 is a cylindrical plug formed of three different materials. Section 214 is made of a first material, section 216 is made of a second material, and section 218 is made of a third material. Each of these materials is different than the material next to it. In an illustrative embodiment, all three materials are different from each other. The specific material chosen may vary, but the material in each section is optically active. The term "optically active" is defined as a substance capable of reflection and refraction of RF energy at a threshold level. In lay persons' terms, the material is "transparent" to RF energy, but the degree of transparency may vary. Because each boundary between two different materials of the plug (or between the plug and the surrounding air or space) is a boundary between differing indices of refraction (explained below), refraction and reflection of the RF energy occurs at each boundary.

Plug 204 is shown with three different sections. However, the number of sections may vary between one and many (more than 3). This particular illustrative embodiment has three sections, because each section, successively, more narrowly focuses the RF energy onto spherical lens 206, with an acceptable loss of RF energy. RF energy may be lost as it is transferred through plug 204, with most losses occurring as a result of reflection at each boundary. Some loss may occur as a result of absorption of RF energy, though the materials of plug 204 are selected to minimize absorption of RF energy. Thus, while theoretically a vast number of sections of plug 204 could focus the RF energy very narrowly onto spherical lens 206, the resulting loss of RF energy may fall below an acceptable threshold. The selection of RF energy loss versus focusing effect is a matter of design choice for a particular application, though in a specific illustrative embodiment, three materials with specifically selected indices of refraction are selected for section 214, section 216, and section 218.

Stated differently, the proposed apparatus (plug 204) serves as an interface between a waveguide aperture (emitter 202) and a spherical dielectric lens (spherical lens 206). At the exit aperture of the waveguide, electromagnetic waves start to radiate out into space (which may be a vacuum or air) and interact with the lens portion of the system. The arrows in FIG. 2 indicate the direction of wave propagation. At each material surface, a ray undergoes reflection and refraction which changes the path of the wave. Solid lines (arrows 208) are refracted rays and dashed lines (arrows 210) represent the portion of the wave reflected off the interface of a given section.

Figure 3:
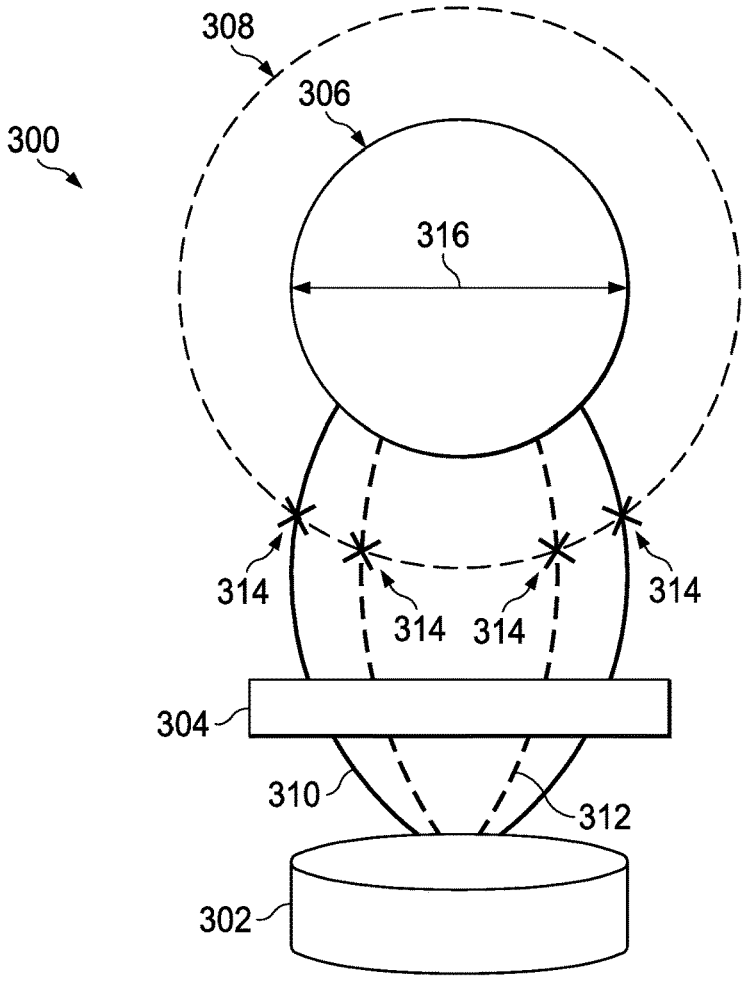
FIG. 3 is an illustration of another view of components of an RF antenna configured to narrow side-lobes, and the effect of a plug as further described below depicted in accordance with an illustrative embodiment.

FIG. 3 is an illustration of another view of components of an RF antenna configured to narrow side-lobes, and the effect of a plug as further described below depicted in accordance with an illustrative embodiment. Thus, antenna 200 and antenna 300 are the same, emitter 202 and emitter 302 are the same, and spherical lens 206 and spherical lens 306 are the same such that width 212 and width 316 are the same. However, FIG. 3 affords a view that shows the focusing effect that plug 304 has on RF energy emitted from emitter 302. FIG. 3 also shows focal length 308 of spherical lens 306 (which is the same as the focal length of spherical lens 206 of FIG. 2). Note that neither FIG. 2 nor FIG. 3 are drawn to scale, and each figure is at a different scale.

As shown in FIG. 3, lines 310 show the RF beam pattern without plug 304, while lines 312 show the RF beam pattern with plug 304. As can be seen, the spread of the RF energy across width 316 of spherical lens 306 is greater without plug 304 relative to antenna 300 having plug 304. Specifically, the presence of plug 304 eliminates focal points through which the RF energy from emitter 302 passes, as shown by "X" symbols 314. Because the RF energy from emitter 302 intersects with fewer focal points, spherical aberration is reduced. Accordingly, undesirable side-lobe energy is also reduced.

Stated differently, the shape as well as the transmission, reflection and refraction properties of plug 304 are optimized to minimize lens spherical aberration. A spherical aberration, for purposes of this specific illustrative embodiment, is a blurring of the RF image formed by a spherical reflection zone. Spherical aberration occurs because parallel rays striking spherical lens 306 far from the optic axis are focused at a different point than are the rays near the axis.

The problem of spherical aberration is usually minimized by using only the center region of a spherical reflection zone. For the case of a spherical dielectric lens, the illuminating source may cause portions of the incident wave of RF energy to intersect the dielectric boundary far from the center line of the source. When this phenomenon occurs in the RF case, the different focal points each cause an antenna lobe to form. The main beam is caused by the focal point that is in line with the axis of the illumination source. The side-lobes are caused by energy being focused from different points outside the lens.

Figure 4:
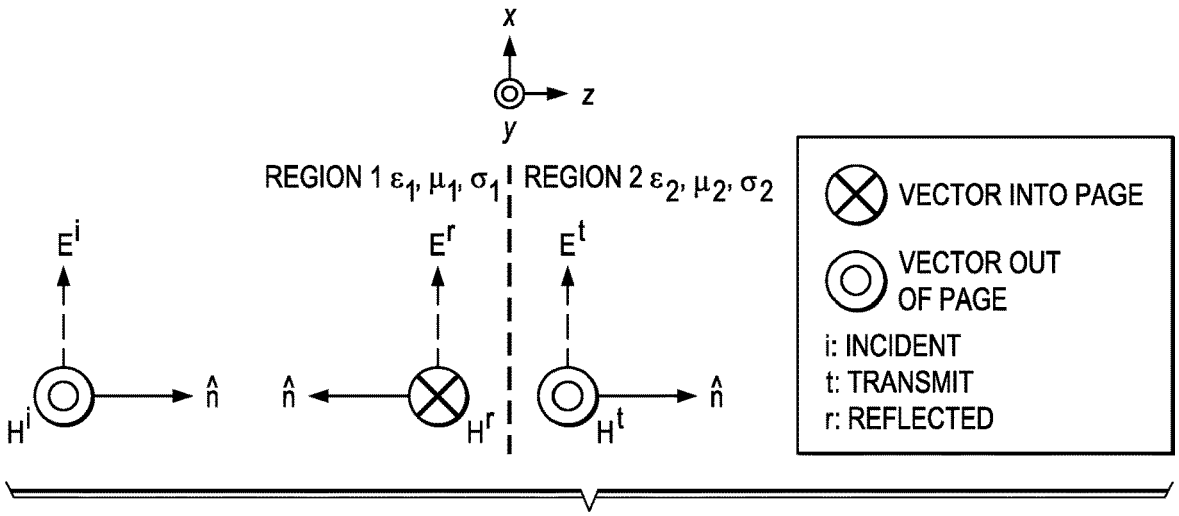
FIG. 4 is an illustration of energy from an incident RF wave being reflected off of an interface depicted in accordance with an illustrative embodiment.

FIG. 4 is an illustration of energy from an incident RF wave being reflected off of an interface depicted in accordance with an illustrative embodiment. Specifically, FIG. 4 describes normal incidence plane wave reflection and transmission at planar boundaries.

To understand the function of the proposed apparatus, we will start with a simplified geometry that explains the underlying physics. Consider a plane wave that is propagating along the positive z-axis with its electric field oriented in the x direction. This wave is incident on an interface separating two media, each with unique permittivity ($\varepsilon$), permeability ($\mu$), and conductivity ($\sigma$). To satisfy the boundary condition between the two regions, some of the energy from the incident wave must be reflected off the interface as depicted.

Two parameters that predict the amplitude of the transmitted and reflected waves are now developed. They are known as the transmission coefficient ($\hat{T}$) given by:

$$\hat{T} = \frac{2\hat{\eta}_2}{\hat{\eta}_1 + \hat{\eta}_2}$$

and the reflection coefficient $\hat{\Gamma}$ given by:

$$\hat{\Gamma} = \frac{\hat{\eta}_2 - \hat{\eta}_1}{\hat{\eta}_2 + \hat{\eta}_1}$$

where $\hat{\eta}$ is the wave impedance based on the properties of the medium given by:

$$\hat{\eta} = \sqrt{\frac{\mu}{\varepsilon - j\frac{\sigma}{2\pi f}}}.$$

The reflection and transmission coefficients are related by $1+\hat{\Gamma}=\hat{T}$, with $-1 \le \hat{\Gamma} \le 0$ and $0 \le \hat{T} \le 1$. For a total reflection off an interface, $\hat{\Gamma}=-1$ causing $\hat{T}=0$ and for no reflection $\hat{\Gamma}=0$ and $\hat{T}=1$. To keep the amount of reflection low, due to a planar interface, the difference in wave impedance between regions should be kept small.

Figure 5:
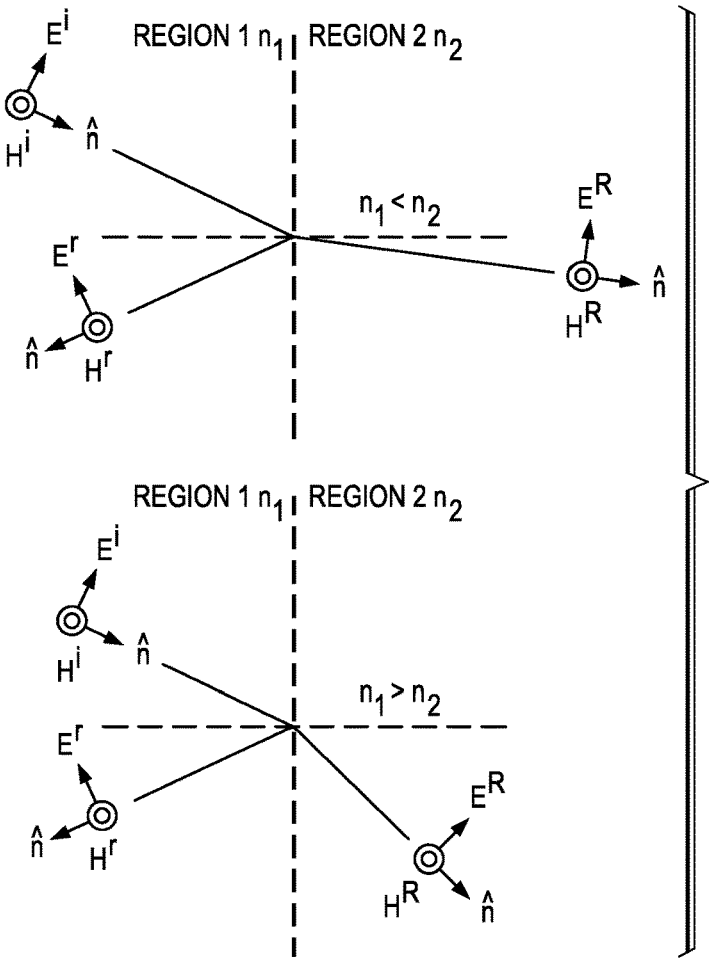
FIG. 5 is an illustration of an RF wave entering a material of larger index of refraction and a wave entering a material of smaller index of refraction depicted in accordance with an illustrative embodiment.

FIG. 5 is an illustration of an RF wave entering a material of larger index of refraction and a wave entering a material of smaller index of refraction depicted in accordance with an illustrative embodiment. FIG. 5 specifically illustrates an oblique incidence plane wave reflection and transmission. FIG. 5 shows an alternative case relative to FIG. 4, and the discussion of FIG. 5 should be considered together with the discussion of FIG. 4.

When a plane wave approaches a boundary at an arbitrary angle of incidence, refraction is introduced. The law of reflection states that the angle of reflection ($\theta_r$) is equal to the angle of incidence ($\theta_i$) for all wavelengths and for any pair of materials, as given by the following equation:

$$\theta_i=\theta_r.$$

The law of refraction states that the angle of incidence ($\theta_i$) and the refracted angle ($\theta_R$) are related to the indexes of refraction for the materials on either side of the interface by the following equation:

$$n_1 \sin(\theta_1)=n_2 \sin(\theta_2), \text{ where } \theta_1=\theta_i \text{ and } \theta_2=\theta_R.$$

There are three general cases of arbitrary incidence with the normal plane wave incidence case already described. The two remaining cases include a wave entering a material of larger index of refraction and a wave entering a material of smaller index of refraction. FIG. 5 illustrates the results of these two cases.

Figure 6:
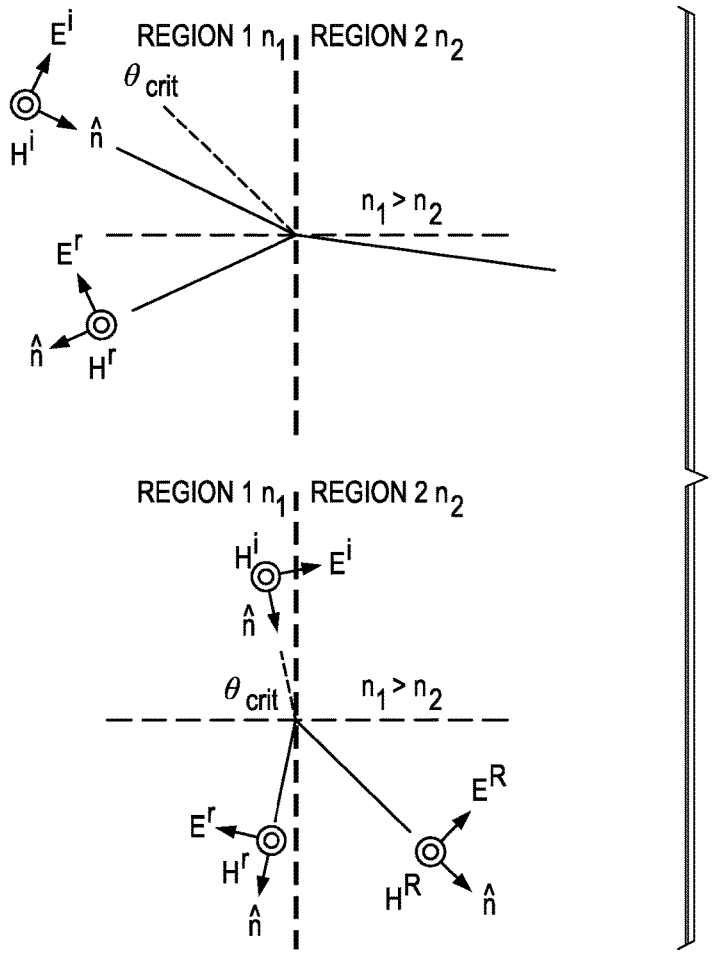
FIG. 6 is an illustration of total internal reflection of an RF wave hitting a material depicted in accordance with an illustrative embodiment.

FIG. 6 is an illustration of total internal reflection of an RF wave hitting a material depicted in accordance with an illustrative embodiment. FIG. 6 specifically shows total internal reflection. FIG. 6 shows an alternative case relative to FIG. 4 and FIG. 5, and the discussion of FIG. 6 should be considered together with the discussion of FIG. 4 and FIG. 5.

There exists a special case of wave propagation that causes all of the transmitted energy from one region to be reflected off the next region. The criteria for this case are that $n_1>n_2$ and the angle of the incoming normal wave must be larger than a critical angle referenced from the material interface normal. The critical angle may be determined by the following equation.

$$\sin(\theta_{crit}) = \frac{n_2}{n_1},$$

where again $n_1$ and $n_2$ are the indices of refraction.

Because all of the energy is reflected, and may occur inside the material, when this phenomena occurs inside a substance this phenomena may be called total internal reflection. More generally, this phenomena may be termed total reflection.

Figure 7:
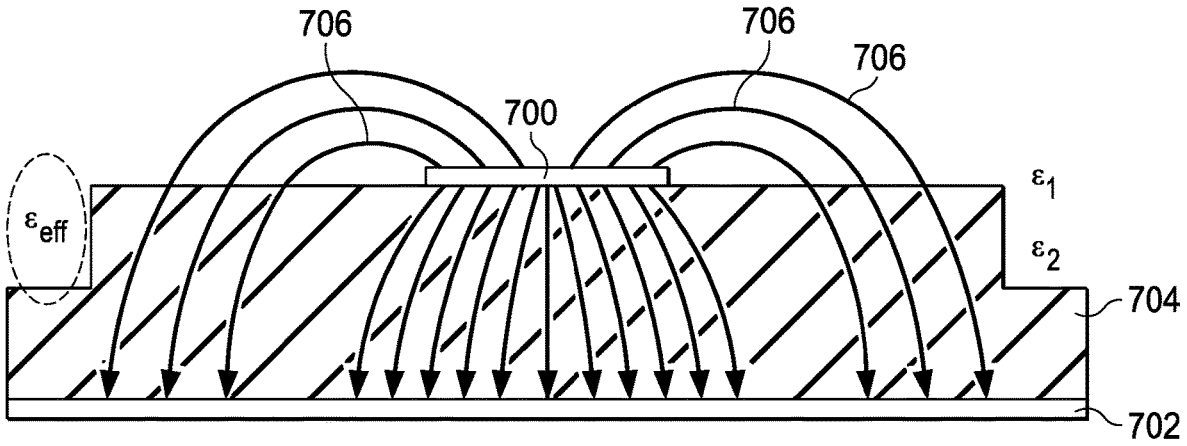
FIG. 7 is an illustration of an electric field distribution in a region of a microstrip line depicted in accordance with an illustrative embodiment.

FIG. 7 is an illustration of an electric field distribution in a region of a microstrip line depicted in accordance with an illustrative embodiment. FIG. 7 illustrates the physical property called permittivity. FIG. 7 shows microstrip 700 and ground plane 702 for microstrip 700. Dielectric 704 is disposed between microstrip 700 and ground plane 702. Electromagnetic field lines 706 are shown by the various arrows in FIG. 7.

Permittivity is an electromagnetic property that is typically defined for electromagnetic fields contained in a homogeneous region or for field lines that encapsulate an inhomogeneous region. The overall permittivity of the region containing the field is generally referred to as the effective permittivity ($\varepsilon_{eff}$). An example illustrating $\varepsilon_{eff}$ is a microstrip line in which the field spans a free space region and dielectric region defined by dielectric 704. FIG. 7 illustrates the electric field distribution in the region near microstrip 700. Controlling the portion of the electric field contained in dielectric 704 and the amount and type of dielectric material present controls $\varepsilon_{eff}$. The value $\varepsilon_{eff}$ directly effects the impedance of the microstrip transmission line. The value of $\varepsilon_{eff}$ is a combination of $\varepsilon_1$ and $\varepsilon_2$.

Figure 8:
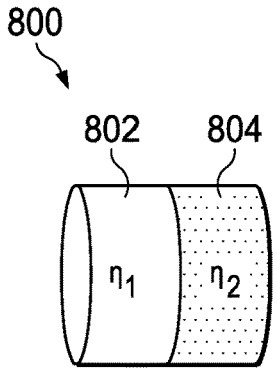
FIG. 8 is an illustration of a cylindrical plug of two different materials depicted in accordance with an illustrative embodiment.
Figure 9:
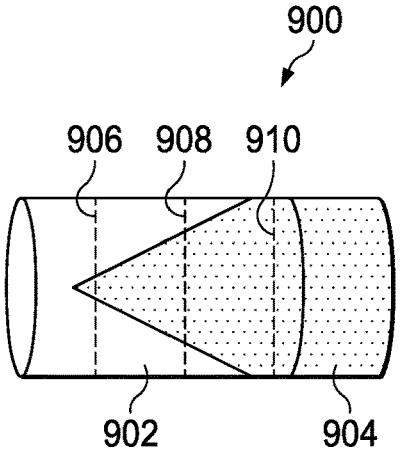
FIG. 9 is an illustration of a cylindrical plug of two different materials and shapes depicted in accordance with an illustrative embodiment.

FIG. 8 and FIG. 9 should be considered together. FIG. 8 is an illustration of a cylindrical plug of two different materials depicted in accordance with an illustrative embodiment. FIG. 9 is an illustration of a cylindrical plug of two different materials and shapes depicted in accordance with an illustrative embodiment.

Figure 10:
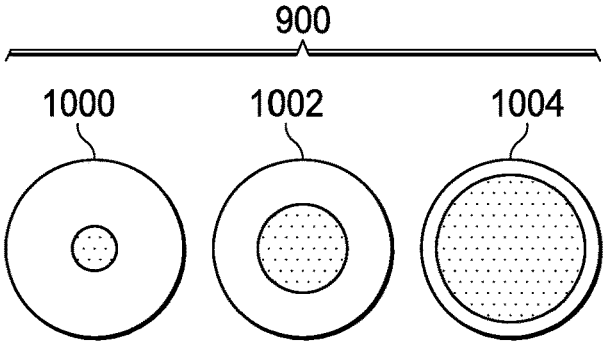
FIG. 10 is an illustration of a cross section of the plug shown in FIG. 9 depicted in accordance with an illustrative embodiment.

FIG. 10 is an illustration of a cross section of the plug shown in FIG. 9 depicted in accordance with an illustrative embodiment. FIG. 10 illustrates an alternative to both FIG. 9 and FIG. 8.

Together, FIG. 8 through FIG. 10 illustrates normal incidence plane wave reflection and transmission produced by varying the effective permittivity of a cross-sectional area. FIG. 8 through FIG. 10 represents alternative devices or plugs that accomplish a similar result relative to the result of the plugs presented in FIG. 2 and FIG. 3. In other words, plug 800 and plug 900 shown here are alternatives to plug 204 of FIG. 2 or plug 304 of FIG. 3.

FIG. 8 shows plug 800, which is a cylinder formed from different optically active materials in first section 802 and second section 804. Because they are of different materials, they have different indices of refraction, as indicated by $\eta_1$ for first section 802 and 12 for second section 804.

FIG. 9 and FIG. 10 show a variation in the structure shown in FIG. 8. In particular, plug 900 is still formed from two different materials, one material in first section 902, and another material in second section 904. These sections may have the same indices of refraction as the materials presented in plug 800 of FIG. 8, or may have still different indices of refraction. However, the more important difference between plug 800 and plug 900 is the shape of second section 904. Second section 904 is a right circular cylinder on a first end, but is a right cone on the other side. The change in angle of the material in the second section further changes how RF energy refracts and reflects when propagating along a longitudinal axis of plug 900.

FIG. 10 shows plug 900 in three different cross sections. Cross section 1000, cross section 1002, and cross section 1004 are drawn from line 906, line 908, and line 910, respectively. As can be seen in FIG. 10, the further along the longitudinal axis of plug 900 towards second section 904, the more area taken up by the second material.

The material in first section 902 and second section 904 (or first section 802 and second section 804) may have different impedances. For FIG. 8, in a scenario where the difference in wave impedance between two regions is large, the reflection coefficient will also be large. To help mitigate reflections in this scenario, a structure that has a gradient region spanning $\hat{\eta}_1$ to $\hat{\eta}_2$ is added, as shown in FIG. 9 and FIG. 10. This structure provides a gradual change in wave impedance between the two regions. Introducing the conic region between the $\hat{\eta}_1$ and $\hat{\eta}_2$ regions creates a geometry that introduces a gradient effect.

Figure 11:
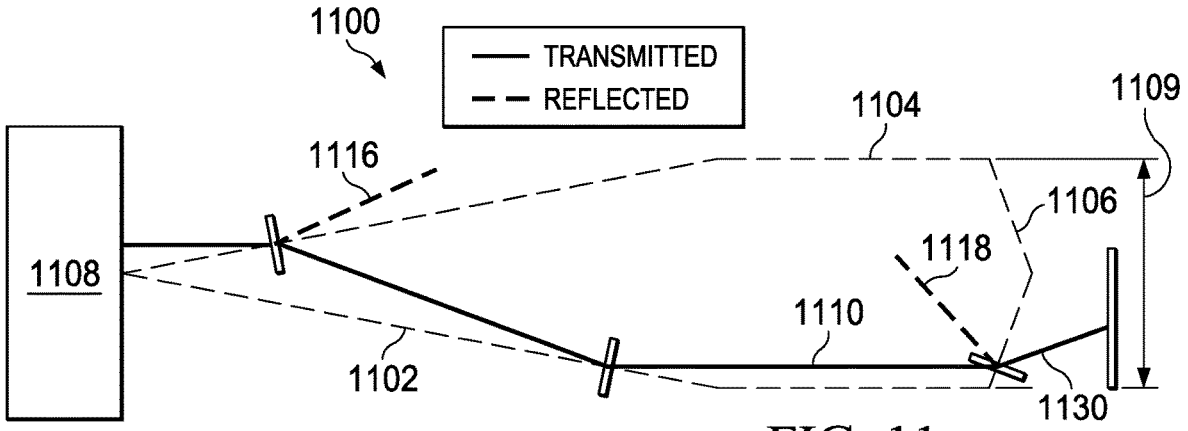
FIG. 11 is an illustration of an RF ray diagram for yet another plug depicted in accordance with an illustrative embodiment.
Figure 12:
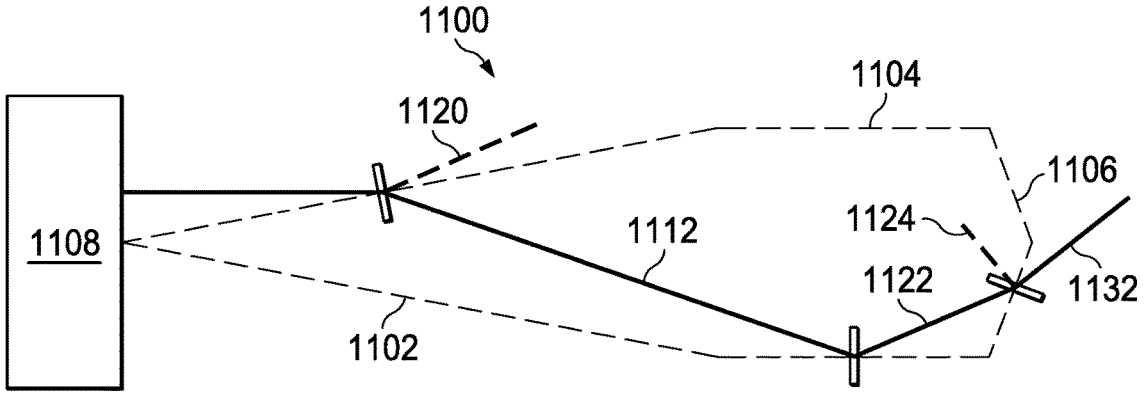
FIG. 12 is an illustration of another RF ray diagram for the plug shown in FIG. 11 depicted in accordance with an illustrative embodiment.
Figure 13:
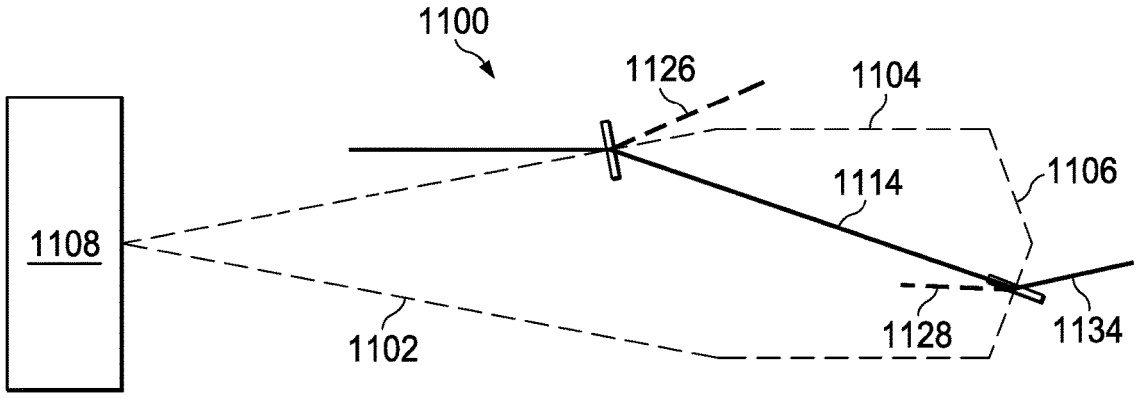
FIG. 13 is an illustration of yet another RF ray diagram for the plug shown in FIG. 11 depicted in accordance with an illustrative embodiment.

FIG. 11 through FIG. 13 should be considered together. FIG. 11 is an illustration of an RF ray diagram for yet another plug depicted in accordance with an illustrative embodiment. FIG. 12 is an illustration of another RF ray diagram for the plug shown in FIG. 11 depicted in accordance with an illustrative embodiment. FIG. 13 is an illustration of yet another RF ray diagram for the plug shown in FIG. 11 depicted in accordance with an illustrative embodiment. The same reference numerals are used with respect to each of FIG. 11 through FIG. 13.

Plug 1100 may be a variation of plug 204 of FIG. 2, plug 304 of FIG. 3, plug 800 of FIG. 8, or plug 900 of FIG. 9 and FIG. 10. In an illustrative embodiment, the geometry of plug 1100 may be used as second section 904 of FIG. 9. In a different illustrative embodiment, plug 1100 may be a stand-alone plug used in an RF antenna, such as plug 204 of FIG. 2 or plug 304 of FIG. 3. In yet another different illustrative embodiment, plug 1100 may be composed of three different materials, such as described with respect to FIG. 2. Thus, plug 1100 may be composed of multiple materials, and/or may be composed of a single unified material, and/or may be part of a larger plug structure. With respect to the description of FIG. 11 through FIG. 13, plug 1100 is described as a single structure made from a unified material. However, this description does not negate the variations described above.

In an illustrative embodiment, plug 1100 has three different sections: first conical section 1102, cylindrical section 1104, and second conical section 1106. First conical section 1102 and second conical section 1106 may be right circular cones, but may be different conical shapes, including irregular conical shapes. They could also be varied from a conical shape. In this illustrative embodiment, first conical section 1102 is a right circular cone having a first base to apex height that is greater than that for second conical section 1106. Cylindrical section 1104 has a radius that about matches the base of first conical section 1102 and second conical section 1106. However, any of these sections may vary in size. In other words, for example, cylindrical section 1104 may have a radius that is larger than the base of first conical section 1102 but smaller than the base of second conical section 1106. Other variations in size are possible, including varying the geometrical shape of cylindrical section 1104 to be something other than a cylinder.

FIG. 11 through FIG. 13 show the specific example of a right circular cone for first conical section 1102, a right circular cone for second conical section 1106 with a height less than that of first conical section 1102, and cylindrical section 1104 having a radius that matches the bases of the two opposing cones.

In this illustrative embodiment, RF emitter 1108 is aimed at first conical section 1102. RF emitter 1108 may be, for example, emitter 202 of FIG. 2. RF emitter 1108 may direct RF energy all along width 1109 of plug 1100. However, the transmissive, refractive, and reflective behavior of RF energy throughout plug 1100 depends on where the RF energy hits plug 1100. The reason, as explained above, is that light path of the RF energy takes the RF energy along differently angled boundaries due to the complex shape of plug 1100. For example, the light path shown in FIG. 11 is different than the light path shown in FIG. 12 or FIG. 13. The reason is that, for the three different light paths, the refracted or transmitted light strikes one of three differently angled areas: in first conical section 1102 (FIG. 11), cylindrical section 1104 (FIG. 12), and second conical section 1106 (FIG. 13).

Additional attention is now turned to each light path. For each of FIG. 11, FIG. 12, and FIG. 13, the solid lines, that is lines 1110, lines 1112, and lines 114, represent the light path of refracted or transmitted RF energy transmitted through plug 1100. The dashed lines, such as line 1116, line 1118, line 1120, line 1122, line 1124, line 1126, and line 1128, represent the light path of reflected RF energy with respect to plug 1100.

Note that some of the reflected RF energy reflects back into plug 1100, and some of the reflected RF energy reflects away from plug 1100. Thus, the actual geometry of RF energy emitted from plug 1100 will be complex, but is represented more fully in FIG. 14 and FIG. 15, below.

However, despite the complex light paths taken by RF energy directed along the width of plug 1100, RF energy that is transmitted all the way through plug 1100 tends to bend towards the direction of the apex of second conical section 1106. This effect is shown at line segment 1130, line segment 1132, and line segment 1134.

Thus, plug 1100 serves to focus more of the RF energy from RF emitter 1108 towards a center line of the longitudinal axis of plug 1100, relative to using the RF emitter alone. This effect, in turn, reduces spherical aberration in an RF antenna with a spherical lens, as explained with respect to FIG. 1 through FIG. 3.

Stated differently, the proposed apparatus of plug 1100 is designed to serve as an interface between a waveguide aperture (such as emitter 202 of FIG. 2) and a dielectric lens (such as spherical lens 206 as shown in FIG. 2). The proposed apparatus takes the waves that would be spread across a large portion of the dielectric lens and focus them on a smaller area of the lens. This focusing effect is achieved by careful material dielectric property selection and/or a specific geometry.

FIG. 11 through FIG. 13 present three wave attributes that contribute to the majority of interactions inside the apparatus. These attributes are transmission, reflection, and refraction. The apparatus may be designed in such a way that internal reflections are minimized and that the waves are refracted out of the apparatus in a desired fashion. Efficient transmission into, through, and out of the apparatus is also accomplished by selection of the shape and/or material(s) of plug 1100.

As indicated above, the dimensions and materials selected for any of the plugs described herein may vary. Nevertheless, the following specific example plug is provided. This specific example does not limit the other illustrative embodiments described above, and does not necessarily limit the claimed inventions.

In this example, a single monolithic plug is composed of a TP20275 extrudable plastic. The plug material has a relative permeability of about 4.4. The shape of this example plug is the same shape shown in FIG. 11 through FIG. 13. For the first conical section, the right circular cone has an angle of about 13.39 degrees, a height of about 10.54 millimeters, and a base radius of about 2.51 millimeters. The cylindrical section has a height of about 2.635 millimeters and a radius of about 2.51 millimeters. For the second conical section, the right circular cone has a height of 0.8783 millimeters and a base of about 2.51 millimeters.

This specific plug is designed for a waveguide that has a cutoff frequency of $f_{cutoff}$=35 GHz & $f_{center}$=40 GHz. The dimensions of the plug are based on the wavelength inside the waveguide, indicated by $\lambda_G$, where $$\lambda_G = \frac{\lambda_{center}}{\sqrt{1 - \frac{f_{cutoff}}{f_{center}}}}.$$

For each selection of $f_{cutoff}$ there will be a unique geometry of the plug.

Figure 14:
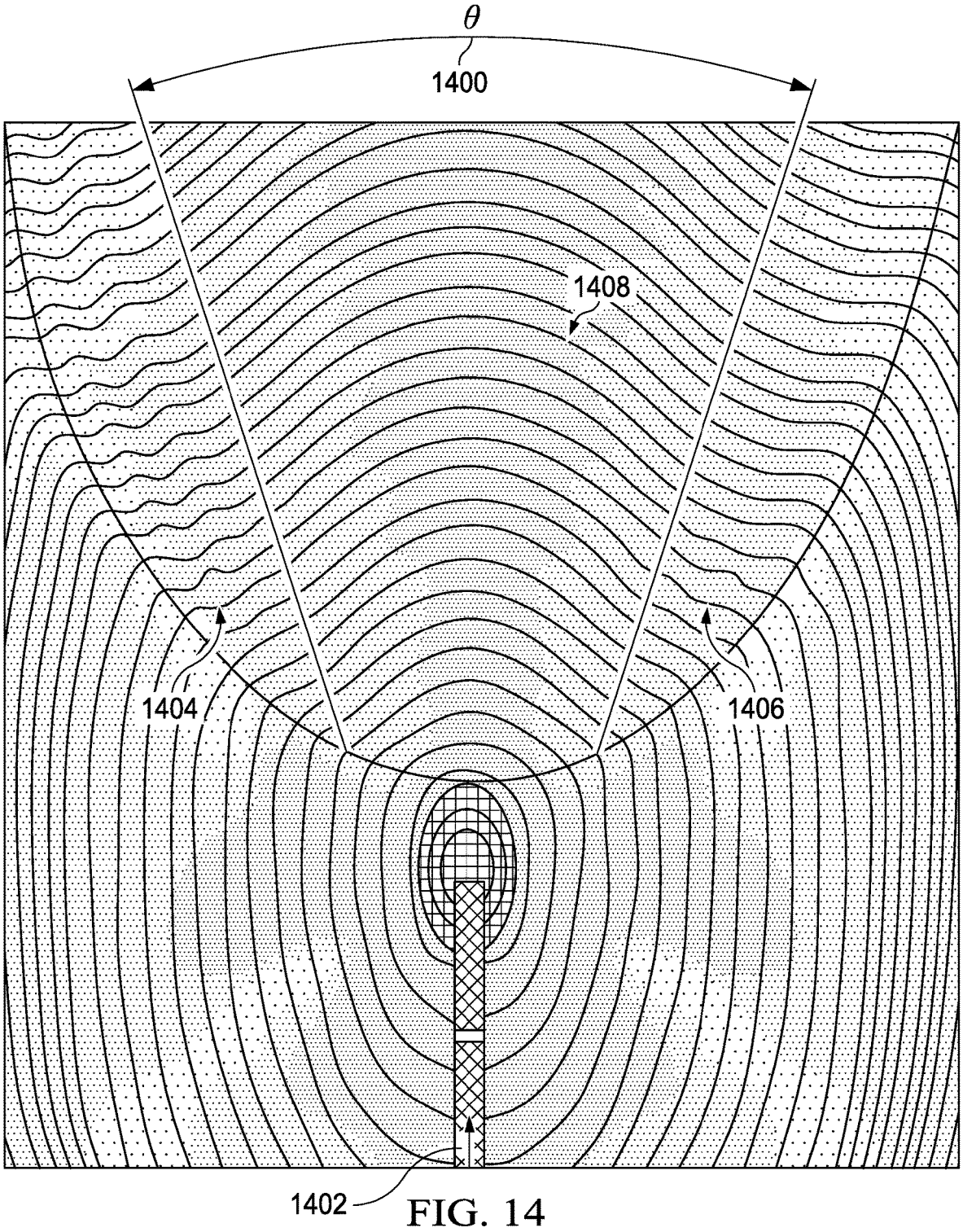
FIG. 14 is an illustration of RF energy from an RF antenna without using a plug as described above depicted in accordance with an illustrative embodiment.
Figure 15:
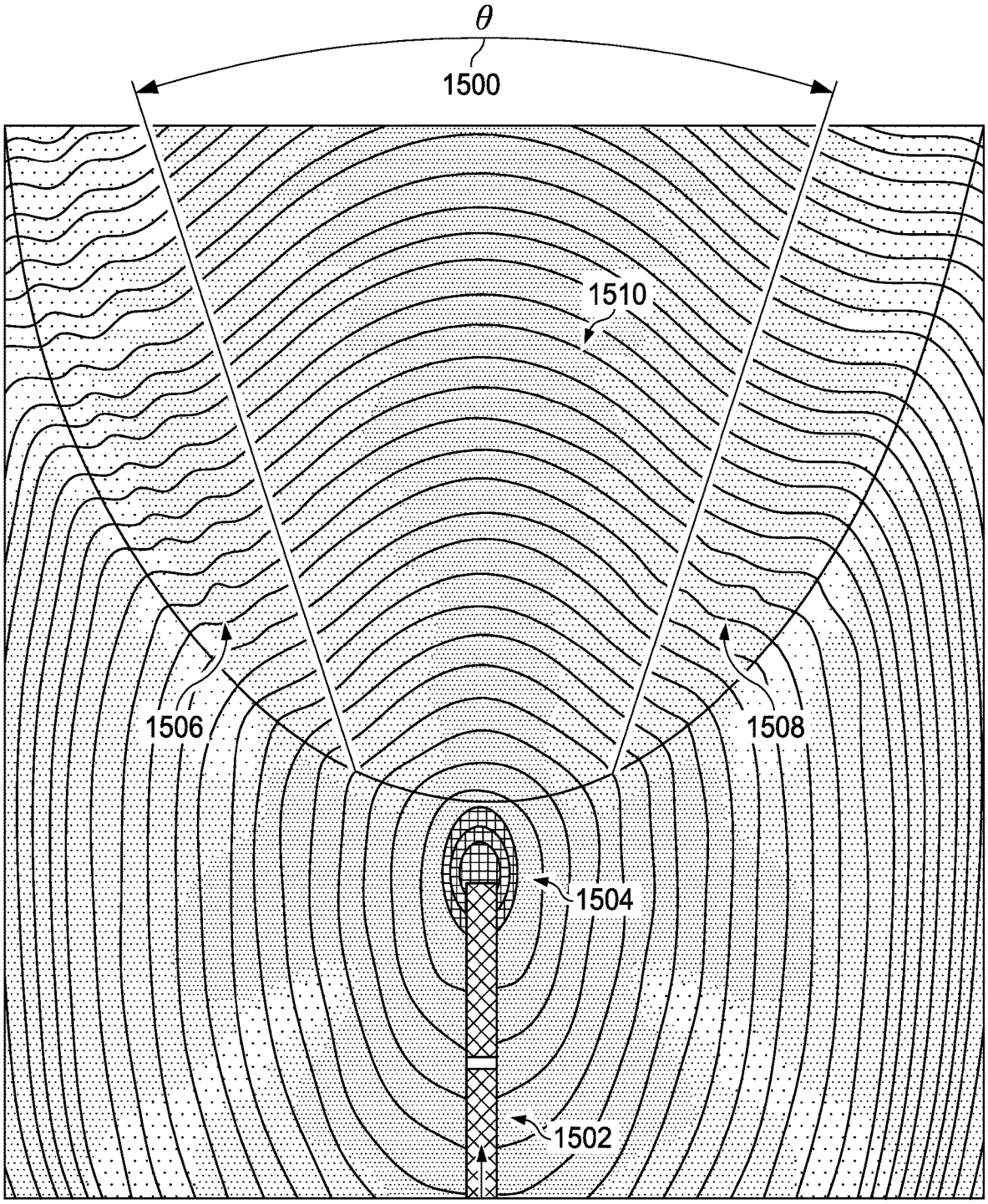
FIG. 15 is an illustration of RF energy from an RF antenna with using a plug as described above depicted in accordance with an illustrative embodiment.

FIG. 14 and FIG. 15 should be contrasted together. FIG. 14 is an illustration of RF energy from an RF antenna without using a plug as described above depicted in accordance with an illustrative embodiment. FIG. 15 is an illustration of RF energy from an RF antenna with using a plug as described above depicted in accordance with an illustrative embodiment. Both FIG. 14 and FIG. 15 represent RF energy distributions taken during an experiment using real emitters and a prototype of the plug.

The wavy lines in both figures represent the distribution of RF energy. For both FIG. 14 and FIG. 15, angle theta 1400 and angle theta 1500 represent the angle of emission from the antenna, as also shown, for example, at main lobe 104 of FIG. 1. Emitter 1402 of FIG. 14 and emitter 1502 of FIG. 15 are identical. However, plug 1504 is placed at the end of emitter 1502, as shown in FIG. 15.

As can be seen from contrasting the RF energy distribution of FIG. 14 with the RF energy distribution of FIG. 15, RF energy side-lobe 1506 and RF energy side-lobe 1508 are reduced compared to RF energy side-lobe 1404 and RF energy side-lobe 1406. Additionally, the RF energy distribution in main lobe 1510 of FIG. 15 is greater than the RF energy distribution in main lobe 1408 of FIG. 14, showing that more RF energy is concentrated in the main lobe when plug 1504 is present. Yet further, because the RF energy distribution is wider in FIG. 14, the RF energy will have a greater spherical aberration when directed at a spherical lens, relative to the RF energy distribution shown in FIG. 15.

Figure 16:
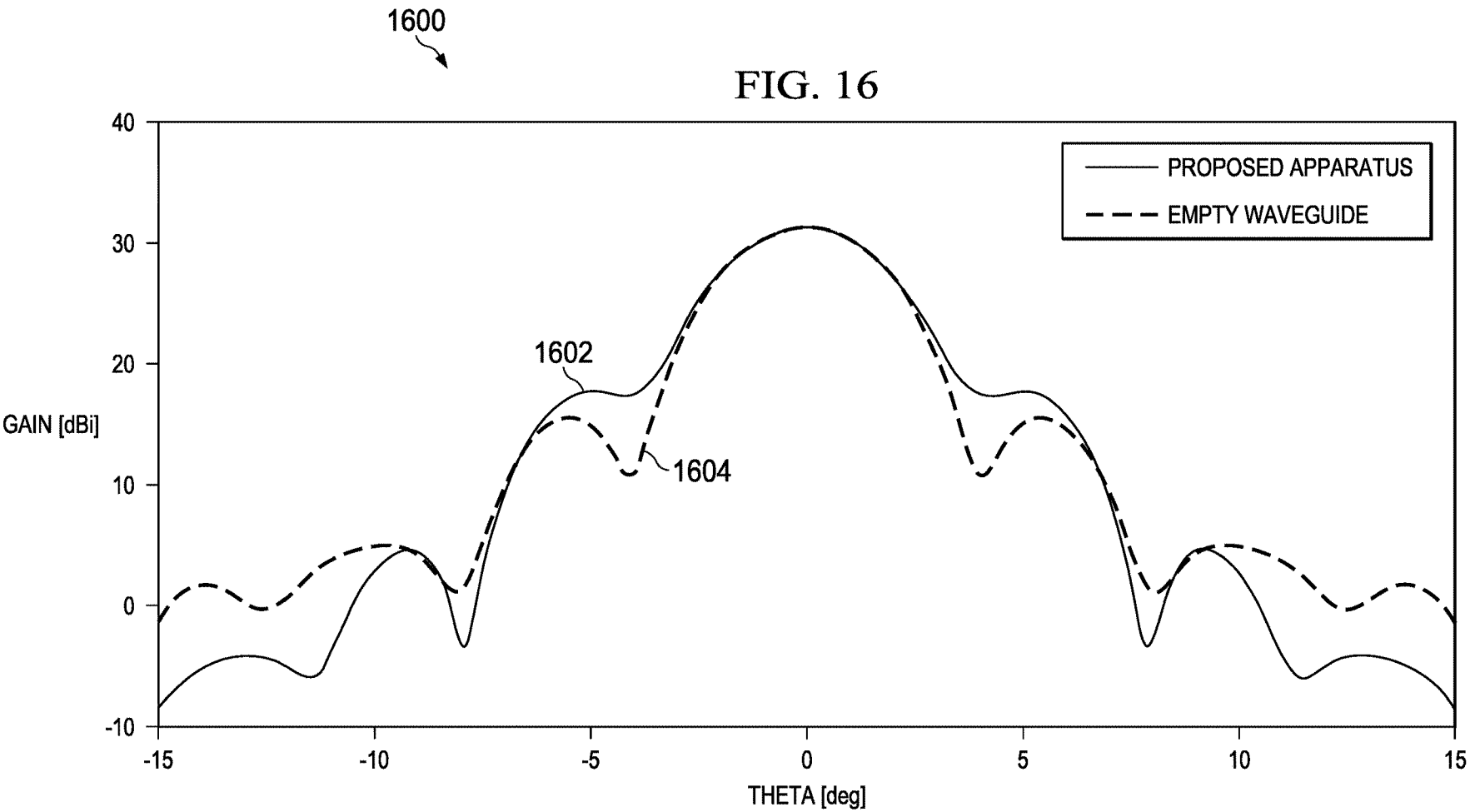
FIG. 16 is a graph of gain versus an angle of RF energy being emitted from an RF antenna depicted in accordance with an illustrative embodiment.

FIG. 16 is a graph of gain versus an angle of RF energy being emitted from an RF antenna depicted in accordance with an illustrative embodiment. Graph 1600 indicates the changes in gain in RF energy at any given angle taken with respect to a longitudinal axis of the emitter, angle theta, for the RF energy patterns presented in FIG. 14 and FIG. 15.

Line 1602 represents the RF energy distribution for an emitter without a plug, as shown in FIG. 14. Line 1604 represents the RF energy distribution for an emitter with a plug, as described herein, as shown in FIG. 15. FIG. 16 represents the RF energy distributions taken during an experiment using real emitters and a prototype of the plug.

As can be seen from FIG. 16 by comparing line 1602 to line 1604, at higher or lower angles—that is farther away from the longitudinal axis of the emitter—the emitter with the plug has lower RF energy values compared to the emitter without the plug. Thus, the plug of the illustrative embodiments is efficacious at reducing side-lobe RF energy and concentrating more of the RF energy at angles closer to the longitudinal axis of the emitter. In this manner, as explained above, the plug is efficacious at reducing spherical aberrations in an RF antenna that uses a spherical lens or some other focusing lens.

Thus, the plug of the illustrative embodiments provides for a number of advantages when used in RF antennas. The illustrative embodiments provide for an unique plug structure geometry and material combination to effectively reduce side-lobes and improve radiation efficiency in waveguide based antenna feeds. The illustrative embodiments provide for a unique design that can be mass produced by additive manufacturing, subtractive manufacturing, or injection molding. The illustrative embodiments provide for improved impedance matching and radiation efficiency of the waveguide feed. Other advantages may also exist.

Figure 17:
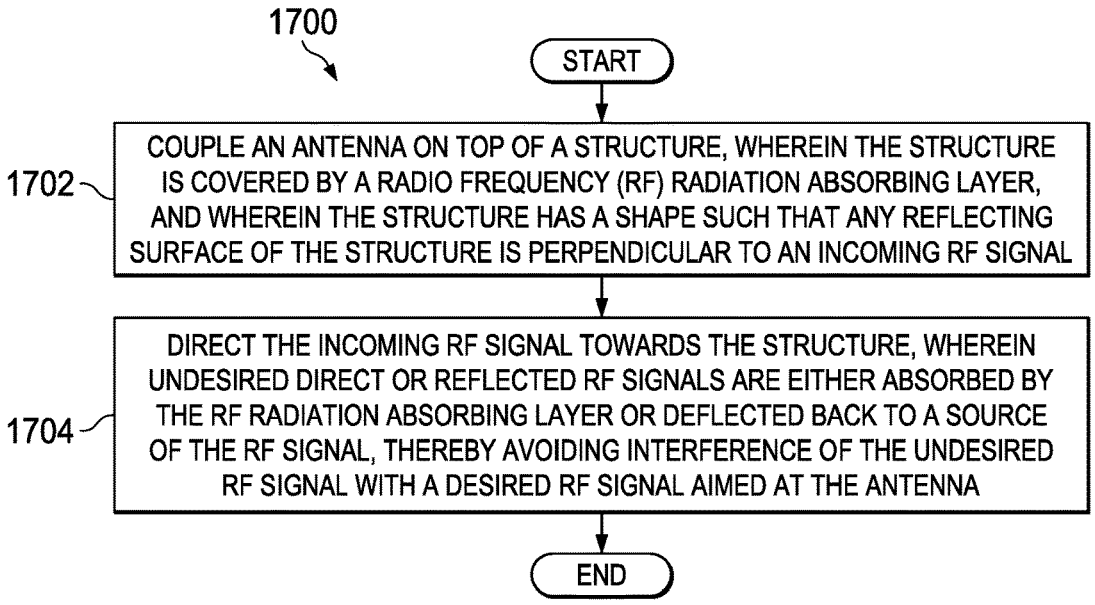
FIG. 17 is a flowchart of a method to mitigate an antenna multipath, Rayleigh fading effect depicted in accordance with an illustrative embodiment.

FIG. 17 is a flowchart of a method to mitigate an antenna multipath, Rayleigh fading effect depicted in accordance with an illustrative embodiment. Method 1700 may be accomplished using an RF antenna having a plug and a spherical lens, such as shown in FIG. 2, FIG. 8 through FIG. 13, and FIG. 15.

Method 1700 may begin by coupling an antenna on top of a structure, wherein the structure is covered by a radio frequency (RF) radiation absorbing layer, and wherein the structure has a shape such that any reflecting surface of the structure is perpendicular to an incoming RF signal (operation 1702). Method 1700 also includes directing the incoming RF signal towards the structure, wherein undesired direct or reflected RF signals are either absorbed by the RF radiation absorbing layer or deflected back to a source of the RF signal, thereby avoiding interference of the undesired RF signal with a desired RF signal aimed at the antenna (operation 1704). In an illustrative embodiment, method 1700 may terminate thereafter.

Method 1700 may be varied. For example, the shape may be a sphere or a hemisphere. The antenna may be coupled to a convex external surface of the structure. In another variation, the RF radiation absorbing layer may be a material selected from the group consisting of: carbon material; foam materials mixed with carbon black; metal and metal particles including solid aluminum metal particles, iron oxide, and powdered iron; a combination of plastics with another substance including latex, polymer blends, or fibers; electrically conducting polymer including polyaniline; and combinations thereof. Other variations of method 1700 are also possible. For example, method 1700 also contemplates manufacturing any of the plugs described above, or directing RF energy using a plug as described above. Thus, method 1700 does not necessarily limit the claimed inventions.

Figure 18:
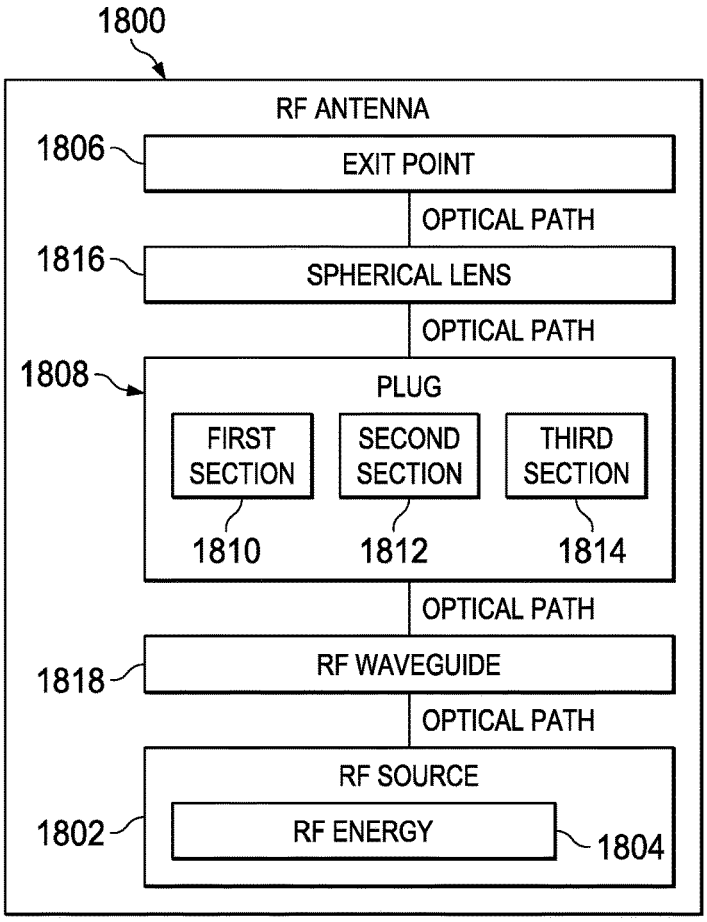
FIG. 18 is a block diagram of an RF antenna depicted in accordance with an illustrative embodiment.

FIG. 18 is a block diagram of an RF antenna depicted in accordance with an illustrative embodiment. RF antenna 1800 may be a variation of antenna 200 of FIG. 2, antenna 300 of FIG. 3, or the antenna shown in FIG. 15. RF antenna 1800 may be characterized as a radio frequency (RF) antenna configured to reduce RF side-lobes caused by spherical aberration.

RF antenna 1800 includes RF source 1802 configured to transmit RF energy 1804 in an optical path defined between RF source 1802 and exit point 1806 from RF antenna 1800. RF antenna 1800 also includes plug 1808 in the optical path after RF source 1802. Plug 1808 is an optically active material with respect to RF energy 1804. Optically active may be defined as a substance capable of reflection and refraction of the RF energy at a threshold level. Plug 1808 has three sections of different shapes, including first section 1810, second section 1812, and third section 1814. RF antenna 1800 also includes spherical lens 1816 in the optical path after plug 1808.

RF antenna 1800 may be varied. For example, first section 1810 may be conical in shape having a first height between a first vertex and a first base of the first section, the first base having a first radius. Continuing this example, second section 1812 may be cylindrical in shape having a first end and a second end. A second radius of the second section may be about equal to the first radius. The first end may be in direct contact with the first base. Continuing this example further, third section 1814 may be conical in shape having a second height between a second vertex and a third base of the third section. A third radius of the third base may be about equal to the first radius. The second height may be less than the first height. The second end of the second section may be in direct contact with the third base of the third section.

RF antenna 1800 may be further varied. For example, for RF energy directed towards the first vertex, the first height is selected to create an angle of the first section of the plug that favors reflection of the RF energy away from an outside surface of the first section, but also favors internal reflection of a first portion of the RF energy that refracts into the first section. In this case, internal reflection of the first portion of the RF energy is favored within the second section, but a second portion of the RF energy that refracts through the second section is directed away from the second section. Also in this case, the second height is selected to focus a third portion of the RF energy that transmits through the third section onto the spherical lens.

In an illustrative embodiment, a distance between the first end of the second section and a center of the spherical lens is a focal length of the spherical lens. In another illustrative embodiment, the first height is about 0.01054 meters, a length of the second section is about 0.002635 meters, the second height is about 0.0008783 meters, the first radius is about 0.00251 meters, a center frequency of the RF energy is about 40 Gigahertz, and a cutoff frequency of the RF energy is about 35 Gigahertz.

Other variations of RF antenna 1800 are also possible. For example, RF antenna 1800 may also include RF waveguide 1818 in the optical path after RF source 1802, but before plug 1808.

In another variation, plug 1808 may be a single unitary material, either with or without the three different sections. Plug 1808 may be made of an extrudable plastic. The extrudable plastic has a relative permittivity of about 4.4.

In still another variation, first section 1810 may be a first right circular cone, second section 1812 may be a right circular cylinder, and third section 1814 may be a second right circular cone. In yet another variation, plug 1808 may be disposed inside a second material that is cylindrical in shape and having a second radius larger than a first radius of plug 1808.

Many other variations are possible. Thus, the illustrative embodiments described with respect to FIG. 18 do not necessarily limit the claimed inventions.

Figure 19:
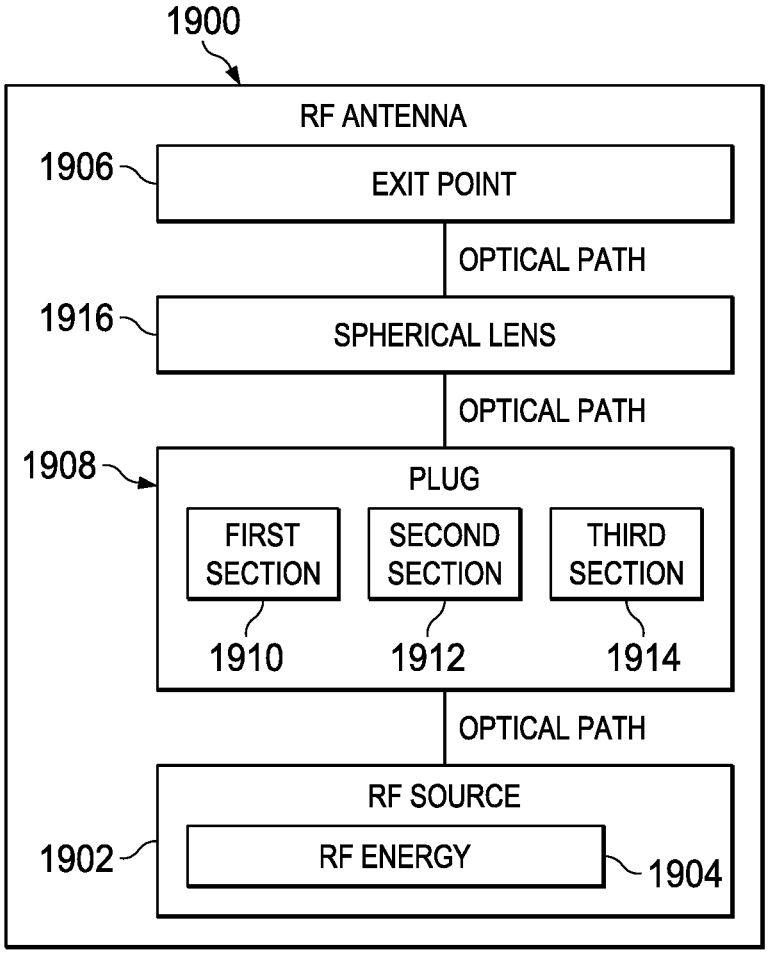
FIG. 19 is a block diagram of another RF antenna depicted in accordance with an illustrative embodiment.

FIG. 19 is a block diagram of another RF antenna depicted in accordance with an illustrative embodiment. RF antenna 1900 may be another variation of antenna 200 of FIG. 2, antenna 300 of FIG. 3, the antenna shown in FIG. 15, or RF antenna 1800 of FIG. 18. RF antenna 1900 may be characterized as a radio frequency (RF) antenna configured to reduce RF side-lobes caused by spherical aberration.

RF antenna 1900 may include RF source 1902 configured to transmit RF energy 1904 in an optical path defined between RF source 1902 and exit point 1906 from RF antenna 1900. RF antenna 1900 also includes plug 1908 in the optical path after RF source 1902. Plug 1908 may be an optically active material with respect to RF energy 1904. Plug 1908 may have three sections of different materials with different permittivities, including first section 1910, second section 1912, and third section 1914. RF antenna 1900 also may include spherical lens 1916 in the optical path after plug 1908.

RF antenna 1900 may be varied. For example, in an illustrative embodiment, first section 1910 may be a first material having a first index of refraction relative to RF energy 1904. In this case, second section 1912 may be a second material having a second index of refraction relative to RF energy 1904, greater than the first index of refraction. Also in this case, third section 1914 may be a third material having a third index of refraction relative to the RF energy, greater than the second index of refraction.

In another illustrative embodiment, at least two of the first material, second material, and third material have different permittivities. A gradient in permittivity may be placed between the at least two of the first material, second material, and third material. The gradient may be conical in shape, or may have another shape.

Many other variations are possible. For example, RF antenna 1900 may also include an RF waveguide. Thus, the illustrative embodiments described with respect to FIG. 19 do not necessarily limit the claimed inventions.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A radio frequency (RF) antenna configured to reduce RF side-lobes caused by spherical aberration, such that the RF antenna comprises:

an RF source configured to transmit RF energy in an optical path defined between the RF source and an exit point from the RF antenna;

a plug in the optical path after the RF source, such that the plug comprises a monolithic and optically active, with respect to RF energy, material, that comprises three sections of different shapes; and a spherical lens in the optical path after the plug.

2. The RF antenna of claim 1, wherein the plug further comprises:

a first section that is conical in shape having a first height between a first vertex and a first base of the first section, the first base having a first radius;

a second section that is cylindrical in shape having a first end and a second end, wherein a second radius of the second section is about equal to the first radius, and wherein the first end is in direct contact with the first base; and a third section that comprises a conical shape having a second height between a second vertex and a third base of the third section, wherein a third radius of the third base is about equal to the first radius, wherein the second height is less than the first height, and wherein the second end of the second section is in direct contact with the third base of the third section.

3. The RF antenna of claim 2, wherein for RF energy directed towards the first vertex:

the first height is selected to create an angle of the first section of the plug that favors reflection of the RF energy away from an outside surface of the first section, but also favors internal reflection of a first portion of the RF energy that refracts into the first section;

internal reflection of the first portion of the RF energy is favored within the second section, but a second portion of the RF energy that refracts through the second section is directed away from the second section; and the second height is selected to focus a third portion of the RF energy that transmits through the third section onto the spherical lens.

4. The RF antenna of claim 2, wherein the first section comprises a first right circular cone, the second section comprises a right circular cylinder, and the third section comprises a second right circular cone.

5. The RF antenna of claim 3, wherein a distance between the first end of the second section and a center of the spherical lens is a focal length of the spherical lens.

6. The RF antenna of claim 3, wherein:

the first height is about 0.01054 meters;

a length of the second section is about 0.002635 meters;

the second height is about 0.0008783 meters;

the first radius is about 0.00251 meters;

a center frequency of the RF energy is about 40 Gigahertz; and a cutoff frequency of the RF energy is about 35 Gigahertz.

7. The RF antenna of claim 1 further comprising:

an RF waveguide in the optical path after the RF source but before the plug.

8. The RF antenna of claim 1, wherein the plug comprises a single unitary material.

9. The RF antenna of claim 8, wherein the plug comprises an extruded plastic.

10. The RF antenna of claim 9, wherein the extruded plastic comprises a relative permittivity of about 4.4.

11. The RF antenna of claim 1, wherein optically active is defined as a substance capable of reflection and refraction of the RF energy at a threshold level.

12. The RF antenna of claim 1, wherein the plug is disposed inside a second material that is cylindrical in shape and having a second radius larger than a first radius of the plug.

13. A radio frequency (RF) antenna configured to reduce RF side-lobes caused by spherical aberration, such that the RF antenna comprises:

an RF source configured to transmit RF energy in an optical path defined between the RF source and an exit point from the RF antenna;

a plug in the optical path after the RF source, such that the plug comprises a monolithic and optically active, with respect to RF energy, material that comprises three sections of different materials with different permittivities; and a spherical lens in the optical path after the plug.

14. The RF antenna of claim 13, wherein the plug further comprises:

a first section comprising a first material having a first index of refraction relative to the RF energy;

a second section comprising a second material having a second index of refraction relative to the RF energy, greater than the first index of refraction; and a third section comprising a third material having a third index of refraction relative to the RF energy, greater than the second index of refraction.

15. The RF antenna of claim 14, wherein at least two of the first material, the second material, and the third material have different permittivities.

16. The RF antenna of claim 15, wherein a gradient in permittivity is placed between the at least two of the first material, the second material, and the third material.

17. The RF antenna of claim 16, wherein the gradient is conical in shape.

18. A method for mitigating Rayleigh fading effect, the method comprising: coupling an antenna on top of a structure, the antenna comprising a plug in the optical path after the RF source, such that the plug comprises a monolithic and optically active, with respect to RF energy, material that comprises three sections of different shapes, wherein the structure is covered by a radio frequency (RF) radiation absorbing layer, and wherein the structure has a shape such that any reflecting surface of the structure is perpendicular to an incoming RF signal; and directing the incoming RF signal towards the structure, wherein undesired direct or reflected RF signals are either absorbed by the RF radiation absorbing layer or deflected back to a source of the incoming RF signal, thereby avoiding interference of the undesired RF signal with a desired RF signal aimed at the antenna.

19. The method of claim 18, wherein:

the shape comprises a sphere or a hemisphere, and wherein the antenna is coupled to a convex external surface of the structure; and the RF radiation absorbing layer is a material selected from the group consisting of: carbon material; coating mats of animal hair mixed with carbon black; metal and metal particles including solid aluminum metal particles, iron oxide, and powdered iron; a combination of polypyrrole with another substance including latex, polymer blends, or fibers; electrically conducting polymer including polyaniline; and combinations thereof.

20. The method of claim 18, wherein the antenna comprises a plug and a spherical lens.

* * * * *